US008118375B2

(12) United States Patent
Berthiaume et al.

(10) Patent No.: US 8,118,375 B2
(45) Date of Patent: Feb. 21, 2012

(54) HEIGHT ADJUSTABLE DESK CONFIGURED FOR STACKING WITH LEGS DETACHED

(76) Inventors: Gilles Berthiaume, Farnham (CA); Pierre Berthiaume, Farnham (CA)

( * ) Notice: Subject to any disclaimer, the term of this patent is extended or adjusted under 35 U.S.C. 154(b) by 247 days.

(21) Appl. No.: 12/458,651

(22) Filed: Jul. 20, 2009

(65) Prior Publication Data

US 2010/0171398 A1 Jul. 8, 2010

(30) Foreign Application Priority Data

Jan. 3, 2009 (GB) ..... 0900040.7

(51) Int. Cl.

| | |
|---|---|
| ***A47B 17/02*** | (2006.01) |
| *A47B 97/04* | (2006.01) |
| *A47B 9/20* | (2006.01) |
| *A47B 7/00* | (2006.01) |
| *A47B 13/00* | (2006.01) |
| *A47B 91/02* | (2006.01) |
| *A47G 23/02* | (2006.01) |

(52) U.S. Cl. ..... 312/195; 312/230; 108/147.21; 108/91; 108/158.11; 248/151; 248/188.8

(58) Field of Classification Search ..... 108/91, 108/25, 26, 147.21, 153.1, 156, 158.11, 158, 108/147.13–15, 147.19; 312/195, 194, 223.3, 312/230, 235.9; 211/189, 186, 188, 194; 248/151, 157; 403/109.1

See application file for complete search history.

(56) References Cited

U.S. PATENT DOCUMENTS

| | | | | |
|---|---|---|---|---|
| 786,402 | A * | 4/1905 | Beal | 108/26 |
| 1,982,138 | A | 11/1934 | Herold | |
| D166,618 | S | 4/1952 | Mince | |
| 2,644,978 | A | 7/1953 | Becker | |
| 2,709,633 | A | 5/1955 | Bargen | |
| 2,840,113 | A | 6/1958 | Simpson et al. | |
| 2,846,285 | A | 8/1958 | Wright | |
| 2,865,133 | A | 12/1958 | Hoven et al. | |
| 3,342,445 | A | 9/1967 | Bouwramp | |
| 3,516,112 | A | 6/1970 | Neville et al. | |
| 3,640,496 | A | 2/1972 | Duncan | |

(Continued)

FOREIGN PATENT DOCUMENTS

DE 4411394 A1 * 10/1994

(Continued)

*Primary Examiner* — David Dunn
*Assistant Examiner* — Ryan A Doyle

(57) ABSTRACT

A desk comprising: a writing board, the writing board defining a top surface and a substantially opposed bottom surface; at least three sleeves, each of the at least three sleeves extending substantially away from the bottom surface, each of the at least three sleeves defining a respective free end substantially opposed to the bottom surface; at least three legs, each of the at least three legs being removably insertable into and securable to a respective one of the at least three sleeves; a first one of the at least three sleeves defining a ridge extending substantially longitudinally therefrom at the free end of the first one of the at least three sleeves and a second one of the at least three sleeves defining a recess extending substantially longitudinally thereinto at the free end of the second one of the at least three sleeves, the recess being configured and sized for substantially snugly receiving the ridge. Two of the desks are stackable on top of each other with legs detached therefrom by inserting the ridge of a first one of the two desks into the recess of a second one of the two desks and inserting the ridge of the second one of the two desks into the recess of the first one of the two desks.

14 Claims, 7 Drawing Sheets

U.S. PATENT DOCUMENTS 3,687,092 A * 8/1972 Manning ..... 108/156
3,758,182 A 9/1973 Barecki et al.
3,784,254 A * 1/1974 Longato ..... 297/451.11
3,794,397 A 2/1974 Flototto
4,105,271 A 8/1978 Sebel et al.
4,415,077 A * 11/1983 Murphy ..... 220/4.26
4,437,411 A 3/1984 Maxwell
4,731,918 A * 3/1988 Burghardt ..... 29/525.12
4,936,472 A * 6/1990 Meier ..... 211/194
4,974,805 A * 12/1990 Douglas ..... 248/447.1
5,088,669 A 2/1992 Zinnbauer
5,107,775 A 4/1992 Langlais et al.
5,169,115 A 12/1992 Chung Hsiang
5,170,972 A 12/1992 Casals Guell
5,287,595 A 2/1994 Stevens, Jr.
D377,448 S 1/1997 Nakamura
5,735,218 A 4/1998 Fewchuk
5,881,653 A * 3/1999 Pfister ..... 108/147.13
5,964,163 A * 10/1999 Cohen ..... 108/91
6,045,108 A * 4/2000 Cziraky ..... 248/454
6,062,149 A * 5/2000 Duvivier et al. ..... 108/158.11
6,062,150 A * 5/2000 Sikora et al. ..... 108/190
6,178,896 B1 * 1/2001 Houk et al. ..... 108/186
6,439,534 B1 * 8/2002 Hensel ..... 248/447.1
6,516,731 B1 * 2/2003 Park ..... 108/153.1
6,553,918 B2 * 4/2003 Bieza ..... 108/43
D474,356 S 5/2003 Bosman et al.
6,623,082 B1 9/2003 Huang
D487,392 S 3/2004 Chase
6,715,430 B2 * 4/2004 Choi et al. ..... 108/153.1
6,761,274 B1 * 7/2004 Chen ..... 211/207
6,834,918 B2 12/2004 Park
6,843,183 B2 1/2005 Strong
6,915,993 B2 7/2005 O'Leary
6,948,435 B1 * 9/2005 Sheng ..... 108/192
7,281,476 B2 * 10/2007 Mills et al. ..... 108/93
7,594,668 B2 * 9/2009 Arceta et al. ..... 280/47.35
7,703,401 B2 * 4/2010 Davis et al. ..... 108/156
2002/0153336 A1 * 10/2002 Wang ..... 211/60.1
2004/0123421 A1 7/2004 Bushey
2005/0115022 A1 6/2005 Desmarais
2005/0172448 A1 8/2005 Jacobson
2008/0136296 A1 * 6/2008 Westbrook et al. ..... 312/194

FOREIGN PATENT DOCUMENTS

WO WO2006/101279 A1 9/2006
WO WO2008/034451 A1 3/2008
WO WO2008/066723 A2 6/2008

* cited by examiner

HEIGHT ADJUSTABLE DESK CONFIGURED FOR STACKING WITH LEGS DETACHED

This application claims priority from GB No. 09000040.7 on Jan. 3, 2009

FIELD OF THE INVENTION

The present invention relates generally to desks and, more particularly, to an improved to a desk having removable legs and which provides a method to stack up the desks in a pre-assembled configuration.

BACKGROUND

School desks having height adjustment means are known in the art and are useful in providing economical, versatile desks that can be used in first grade school classes as well as in adult classes.

Noticeable examples of the prior art are U.S. Pat. Nos. 2008/0136296A1, to Westbrook et Al. (2008), U.S. Pat. No. 6,843,183 B2, to Strong (2005), U.S. Pat. No. 5,107,775, to Langlais (1992), U.S. Pat. No. 4,437,411, to Maxwell (1984), and U.S. Pat. No. 3,794,397, to Flototto (1974).

While these prior art devices generally offer a school desk having height adjustment means, they also entail one or more of the following disadvantages.

First, when disassembled, they are generally cumbersome to manipulate and difficult to efficiently stack up in a stable space-saving manner for storage or shipping purposes;

Also, their height adjustment means are generally visible and, thus, render the desk somewhat less visually aesthetic.

Finally, in some cases, they generally comprise complex components that are relatively expensive to produce.

Against this background, there exist a need for a new and improved desk that avoids the aforementioned disadvantages. It is a general object of the present invention to provide a new and improved desk.

SUMMARY OF THE INVENTION

In a broad aspect, the invention provides a desk, the desk comprising: a writing board, the writing board defining a top surface and a substantially opposed bottom surface; at least three sleeves, each of the at least three sleeves extending substantially away from the bottom surface, each of the at least three sleeves defining a respective free end substantially opposed to the bottom surface; at least three legs, each of the at least three legs being removably insertable into and securable to a respective one of the at least three sleeves; a first one of the at least three sleeves defining a ridge extending substantially longitudinally therefrom at the free end of the first one of the at least three sleeves and a second one of the at least three sleeves defining a recess extending substantially longitudinally thereinto at the free end of the second one of the at least three sleeves, the recess being configured and sized for substantially snugly receiving the ridge. Two of the desks are stackable on top of each other with legs detached therefrom by inserting the ridge of a first one of the two desks into the recess of a second one of the two desks and inserting the ridge of the second one of the two desks into the recess of the first one of the two desks.

In another broad aspect, the invention provides a desk, the desk comprising: a writing board, the writing board defining a top surface and a substantially opposed bottom surface; at least three sleeves, each of the at least three sleeves extending substantially away from the bottom surface, each of the at least three sleeves defining a respective free end substantially opposed to the bottom surface; at least three legs, each of the at least three legs being removably insertable into and securable to a respective one of the at least three sleeves. The free end of a first one of the at least three sleeves is shaped substantially complementarily to the free end of a second one of the at least three sleeves such that, with the at least three legs removed from the at least three sleeves, when a first one and a second one of the desks are stacked on top of each other with the first one of the at least three sleeves of the first desk engaging the second one of the at least three sleeves of the second desk at their respective free ends, movements of the two desks relatively to each other in a direction substantially parallel to the writing boards of the two desks is substantially prevented.

In some embodiments of the present invention, the desk generally comprises a writing board, a substantially tray-shaped book box for holding learning materials, a plurality of substantially cylindrically-shaped sleeve inserts paired with a corresponding number of substantially elongated legs, with each leg typically terminated with a conventional furniture leg glide or end cap.

The tray-shaped book box has a substantially square or rectangular horizontal configuration that is generally defined by a bottom wall, a front end wall and a pair of oppositely disposed side walls. The rear end defines an opening through which a student can stowaway learning and/or writing materials. Each corner of the tray-shaped book box is provided with a substantially vertically oriented substantially tubular sleeve.

A suitable configuration of a plurality of corresponding through holes along a lower distal end portion of the sleeves of the book box and the sleeve inserts, in cooperative relation with a plurality of height adjustment holes along an upper portion of the leg members, allows a relatively fast and easy way of adjusting the height of the desk using conventional fasteners, such as screws.

Furthermore, the tubular lower end of the sleeves on each side of the front of the desk are provided with an outer substantially circumferential ridge, while the tubular lower end of the sleeves on each sides of the rear end of the desk are provided with a compatibly shaped inner substantially circumferential recess.

Thus, two pre-assembled book box and writing boards may be paired for efficient space saving storage and/or shipping purposes by turning a first pre-assembled book box upside down on a stable surface and then firmly engaging on top of its upwardly extending sleeves the compatibly shaped sleeves of a second pre-assembled book box, this one in an upstanding attitude and with its front end directed in an opposite direction relative to the first pre-assembled book box turned upside down.

Hence, a plurality of thus paired pre-assembled book boxes may in turn be efficiently and stably stacked one on top of the other.

To complete a full assembly of a desk, sleeve inserts are inserted through the lower open end of each sleeve of a pre-assembled book box, as described above, followed with the insertion of the top end of legs in the lower open end of the thus inserted sleeve inserts. Suitable fastener, such as screws, may then be used to rigidly fasten the thus coaxially assembled sleeves, sleeve inserts and legs such that the desk may have a desired height.

In some embodiments of the invention, at least one leg includes a leg member and a substantially tubular sleeve insert, the sleeve insert being insertable in one of the sleeves, the leg member being insertable in the sleeve insert. The leg member is provided with at least two substantially longitudinally spaced apart leg apertures extending substantially laterally thereinto, the sleeve insert being provided with a sleeve insert aperture extending substantially laterally thereinto. When the leg is attached to the sleeve, one of the leg apertures, the sleeve insert aperture and the sleeve aperture are substantially in register with each other a fastener is inserted through the leg apertures, the sleeve insert aperture and the sleeve aperture. Selection of different leg apertures to attach the leg to the sleeve vary a length of the leg. Advantageously, a single fastener is used to adjust the length of the leg and to attach the leg to the sleeve. This fastener is conveniently located substantially adjacent to the writing surface. Also, this structure is relatively robust.

Some advantages of the present invention are to provide a height adjustable desk which is relatively durable and relatively easy to assemble; whose configuration and pre-assembly mode allows for relatively efficient space saving for storage and shipping; whose unique and novel way of adjusting the height of the desk through portions of the integrally formed book box of the desk renders the latter visually aesthetic since the fastening means used to adjust the height of each leg is substantially concealed from view; and which is relatively simple and economical to produce.

Other objects, advantages and features of the present invention will become more apparent upon reading of the following non-restrictive description of preferred embodiments thereof, given by way of example only with reference to the accompanying drawings.

DETAILED DESCRIPTION

Figure 1A:
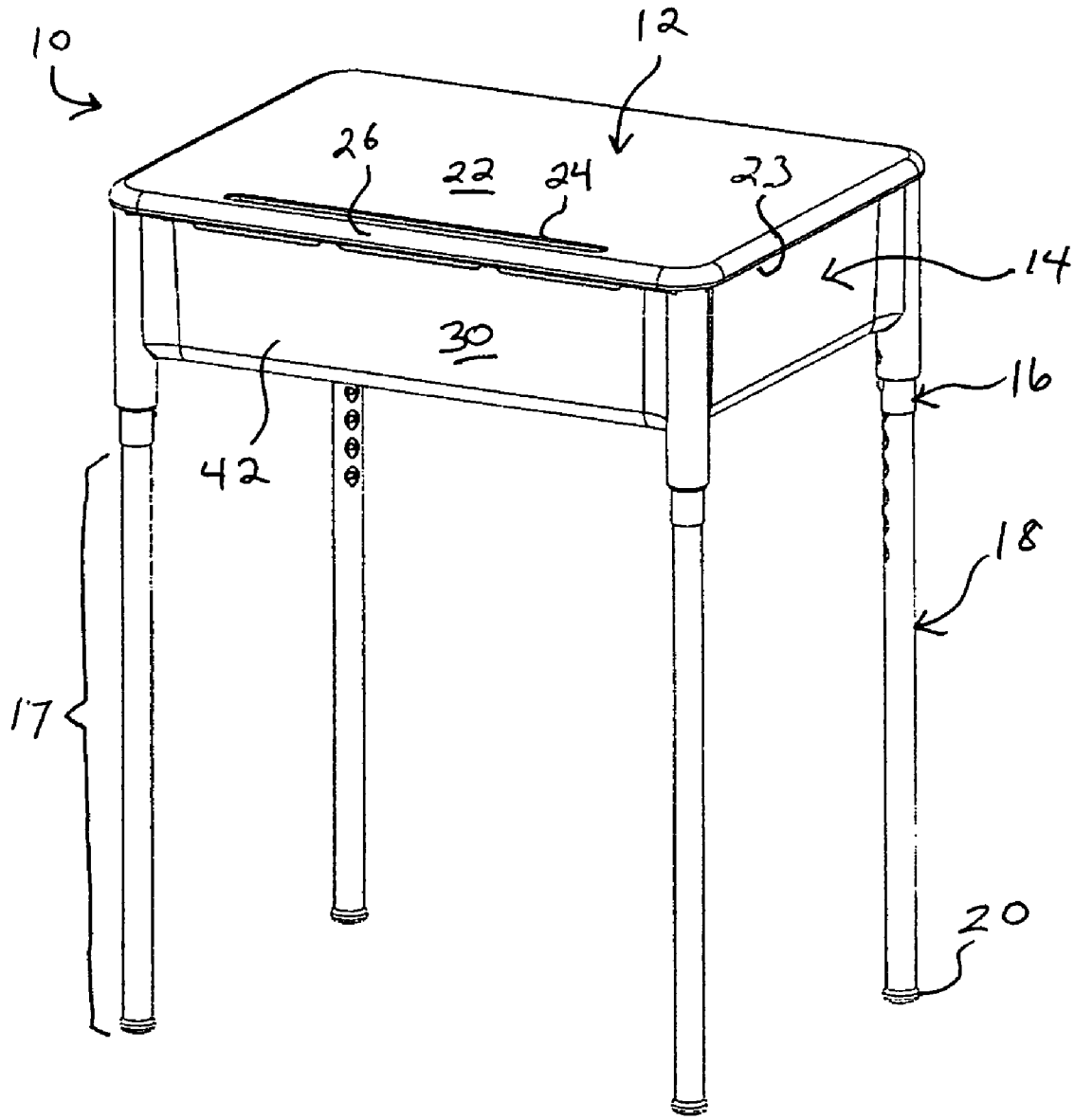
FIG. 1A, in a front-top perspective view, illustrates a desk according to an embodiment of the present invention.
Figure 1B:
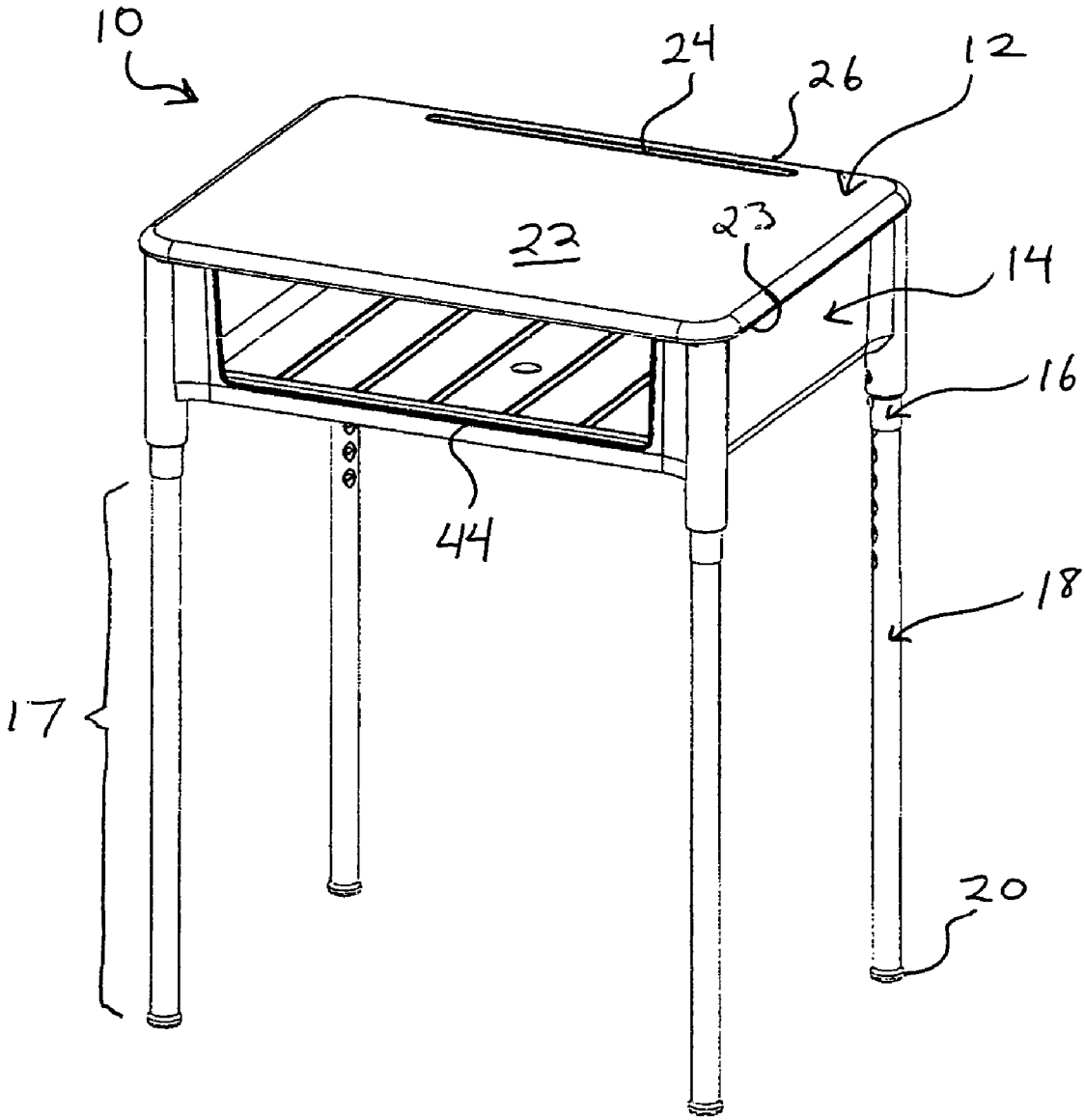
FIG. 1B, in a rear-top perspective view, illustrates the desk of FIG. 1A.
Figure 2:
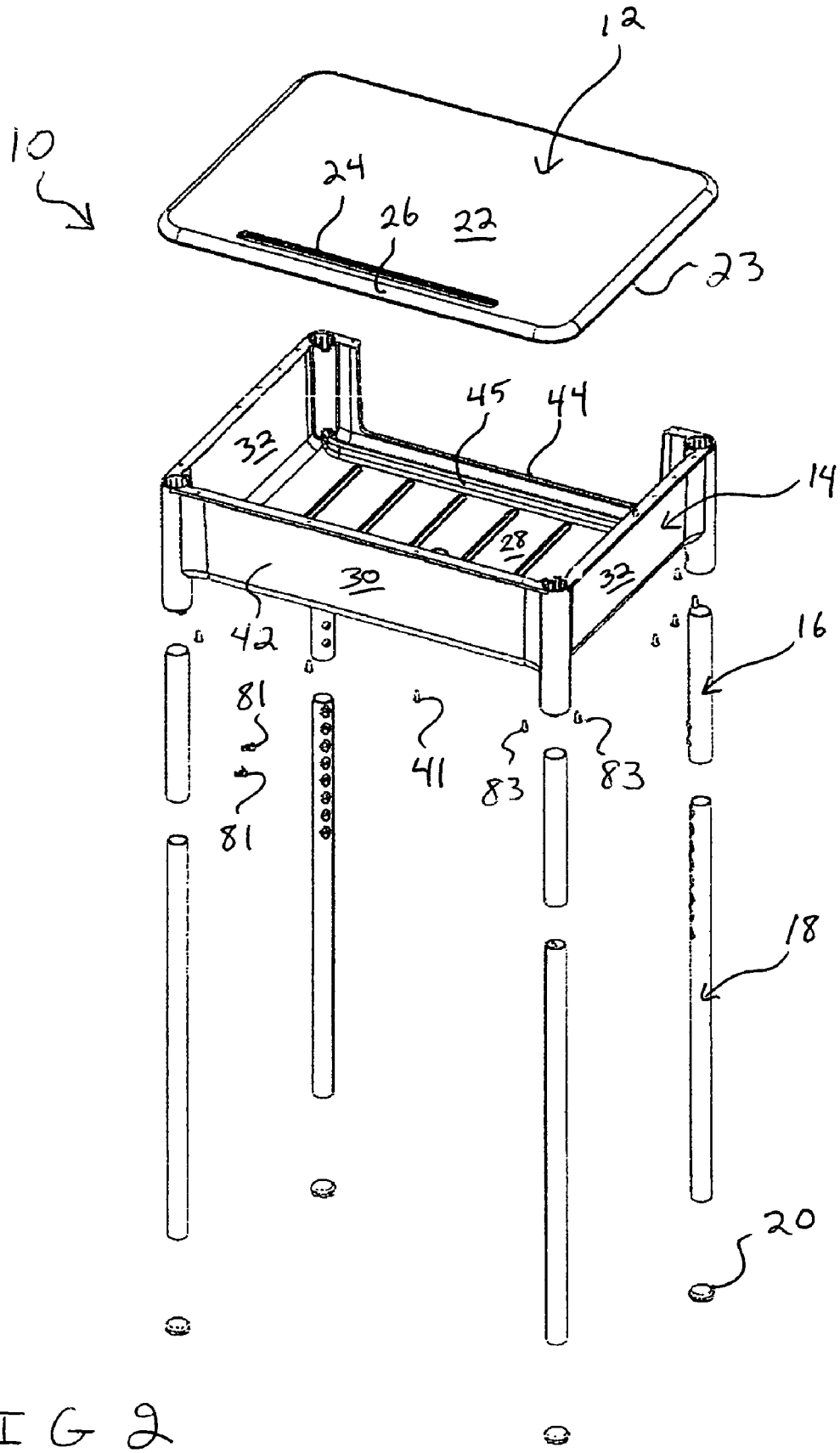
FIG. 2, in an exploded front-top perspective view, illustrates the desk of FIGS. 1A and 1B.

FIGS. 1A, 1B and 2 best show the various aspects of an embodiment of a desk 10 according to the present invention. Referring to FIG. 1A, the desk 10 is usable as a school desk, but other uses are within the scope of the present invention. The desk 10 generally comprises a writing board 12, a substantially tray-shaped book box 14 for holding learning materials, a plurality of cylindrically-shaped and substantially tubular sleeve inserts 16 paired with a corresponding number of elongated leg members 18. Each leg members 18 is typically terminated with a conventional furniture leg glide or end cap 20.

The writing board 12 is represented by a substantially rigid and planar element that may be constructed of a single molded material, a lamination of wood products and melamine laminates, or a variety of other materials. The writing board 12 defines a top surface 22 and a substantially opposed bottom surface 23. In some embodiments, the top surface 22 of the writing board 12 may be provided with an elongated groove 24 generally disposed in a parallel fashion along an edge 26 of the writing board 12 that generally represents the front end 42 of the assembled desk 10. Elongated groove 24 is suitably configured to stably hold in place an horizontally disposed pen or pencil laid therein when not in use, or to prevent such writing tools from freely rolling off the top surface 22 of the desk 10.

The writing board 12 is suitably sized and shaped such that its peripheral edges typically slightly protrude the overall horizontal cross-section of the underlying book box 14, described hereinafter.

Figure 3:
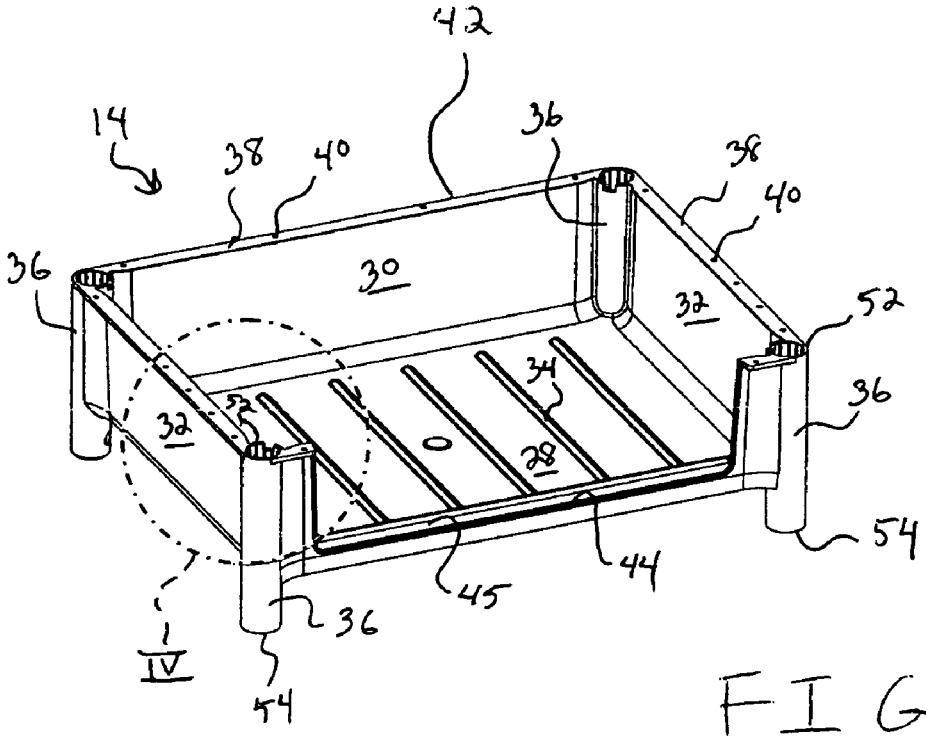
FIG. 3, in a rear-top perspective view, illustrates a book box part of the desk shown in FIGS. 1A to 2.
Figure 5:
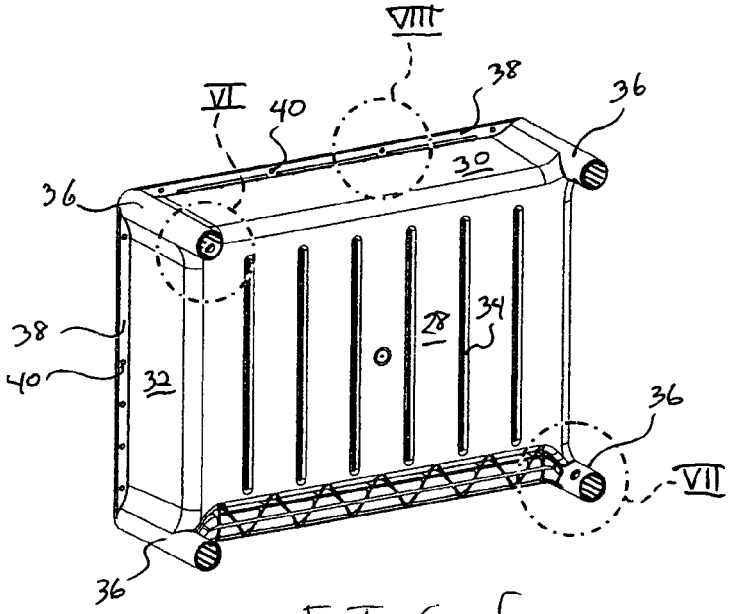
FIG. 5, in a front-bottom perspective view, illustrates the book box shown in FIG. 3.

Referring for example to FIG. 3, in some embodiments of the invention, the tray-shaped book box 14 is represented by an integrally formed one piece element comprising a substantially square or rectangular shaped bottom wall 28 delimited by a front end wall 30 and a pair of oppositely disposed side walls 32. The bottom wall 28 is preferably provided with structural reinforcement rib patterns, such as the longitudinally disposed elongated ribs 34, to help support relatively heavy books that may be stored thereon. FIG. 5 illustrates some of these aspects from a different perspective.

The book box 14 further comprises at least three, but typically four substantially cylindrically-shaped sleeves 36 disposed along a generally vertical axis at each corner of the book box 14. Each sleeve 36 therefore extends at the periphery of the book box 14. Each sleeve 36 extends substantially away from the bottom surface 23 and is substantially perpendicular to the writing board 12.

Peripheral ledges 38 are laterally outwardly extending from the upper edges of the front and side walls 30 and 32 respectively. The peripheral ledges 38 are provided with a plurality of vertical through holes 40 and cooperatively define a substantially planar fastening structure for stably fastening the book box 14 to the underside of the writing board 12 using any suitable means such as, for example, screws 41, or the like (as illustrated in FIG. 2).

The integrally formed book box 14 is preferably made of a suitably rigid material such as plastic using a conventional injection molding process.

Returning to FIG. 3, the front end wall 30 of the book box 14 generally represents the front end 42 of the assembled desk 10, while the opposite, open end of the book box 14 generally represents the rear end 44 of the assembled desk 10 through which learning and/or writing materials may be stowed away in the interior space defined therein.

In some embodiments of the invention, an elongated open tray 45, for holding writing tools or the like, is integrally formed along an inner bottom edge of the open rear end 44 of the book box 14.

Figure 8:
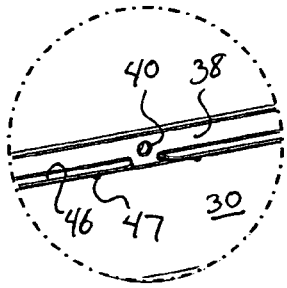
FIG. 8, in an enlarged partial view taken along section line VIII of FIG. 5, illustrates an underside portion of a front end flange part of the desk shown in FIGS. 1A to 2.

FIG. 8 shows a plurality of elongated lips 46 perpendicularly downwardly projecting from the underside of the ledge 38, adjacent the front end wall 30, and generally disposed in a substantially parallel fashion relative to the latter. In turn, each elongated lip 46 is provided with a plurality of relatively small and perpendicularly inwardly projecting notches or flanges 47. Inwardly projecting flanges 47 have their distal ends extend suitably close along the surface of front end wall 30 such that the elongated straight edge of a sheet of paper, a relatively thin cardboard, or the like (not shown), may be slided upwardly there between and held in place in a tight-fit relation. Thus, the elongated lips 46 and notches 47, in cooperative relation with the front end wall 30, may conveniently form a clip element extending away from the bottom surface 23 of the writing board 12 (both not seen in FIG. 8) and used to hold in place a piece of paper on which may be inscribed, for example, the name of the student occupying the desk, the name of a class team, the title of a school program, or the like.

Figure 4:
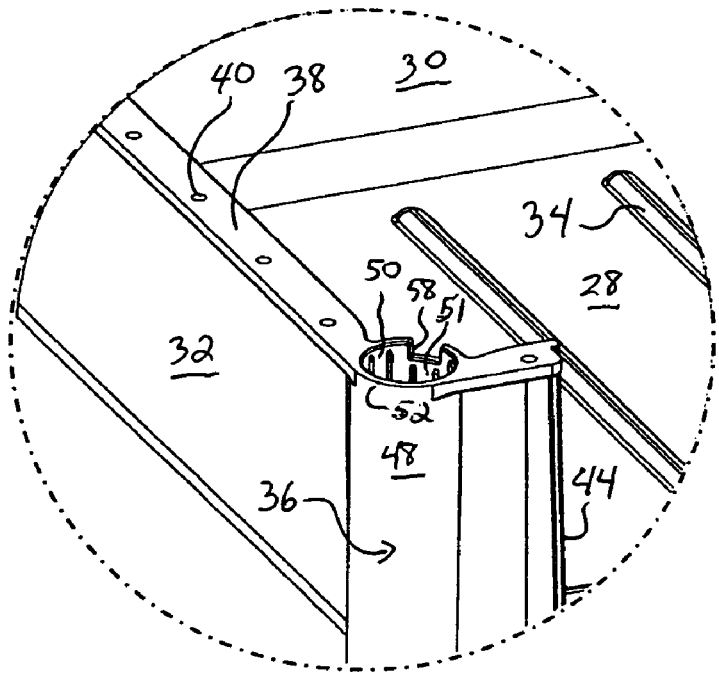
FIG. 4, in an enlarged partial view taken along section line IV of FIG. 3, illustrates the top end opening of a sleeve part of the desk shown in FIGS. 1A to 2.
Figure 6:
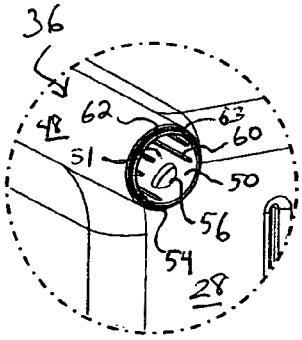
FIG. 6, in an enlarged partial view taken along section line VI of FIG. 5, illustrates the bottom end opening of a front-end sleeve of the book box shown in FIGS. 3 and 5.
Figure 7:
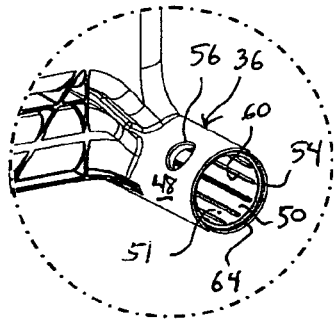
FIG. 7, in an enlarged partial view taken along section line VII of FIG. 5, illustrates the bottom end opening of a rear-end sleeve of the book box shown in FIGS. 3 and 5.

As best illustrated in FIGS. 6 and 7, the sleeve 36 at each corner of the book box 14 defines a sleeve outer surface 48 a sleeve inner surface 50. The sleeve inner surface 50 defines a substantially cylindrical passageway 51 having an upper end 52, as shown in FIG. 4, and a lower end 54, as best shown in FIGS. 6 and 7. The upper end 52 of the sleeves 36 preferably coincides with the peripheral ledges 38 defining the upper end of the book box 14, while the lower end 54 of the sleeves 36 may slightly perpendicularly protrude from the underside surface of bottom wall 28 of the book box 14, as best illustrated in FIG. 5. The lower end 54 is therefore a free end of the sleeve 36.

The thus downwardly protruding portion of the lower end 54 is provided with a sleeve aperture 56 leading substantially laterally thereinto between the sleeve inner and outer surfaces 48 and 50. The sleeve aperture 56 is therefore substantially adjacent the free end of the sleeve 36. The purpose of the sleeve aperture 56 will be explained in cooperative relation with a preferred mode of assembly of the leg members 18 with the book box 14, which will be described in more details below. The sleeve aperture 56 is disposed through an inwardly oriented portion of the sleeve outer surface 48, as best illustrated in FIG. 7.

As better seen in FIG. 4, the upper end 52 of each sleeve 36 is provided with an optional, and relatively small slot 58 located, here again, at an inwardly oriented portion of the sleeve outer surface 48 of the sleeve 36, as best illustrated in FIG. 4. Slot 58 may be optionally used for future alternate versions of sleeve inserts (not shown).

As best shown in FIG. 6, the sleeve inner surface 50 is typically provided with a plurality of circumferentially distributed elongated ribs 60 that are longitudinally extending substantially the whole length of each sleeve 36. Elongated ribs 60 help ease the insertion of a sleeve insert 16 in the sleeve 36.

Furthermore, the lower ends 54 of the pair of sleeves 36 on each side of the front wall 30 of the book box 14 have a different distal end configuration compared to the lower ends 54 of the pair of sleeves 36 on each side of the open rear end 44. Thus, the pair of sleeves 36, parallelly disposed on each side of the front end wall 30 of the book box 14 are both provided with an outer circumferential groove 62, and therefore define a substantially annular ridge 63 extending substantially away from the sleeves 36, as shown in FIG. 6, while the lower ends 54 of the pair of sleeves 36 parallelly disposed on each side of the rear open end 44 are both provided with an inner circumferential groove 64, as shown in FIG. 7, the groove 64 being a substantially annular recess extending substantially longitudinally into the sleeves 36. the inner circumferential groove 64 is configured and sized for substantially snugly receiving the ridge 63.

The outer circumferential groove 62 of the pair of lower ends 54 at the front end 42 of the desk are compatibly shaped to be engageable with the inner circumferential grooves 64 of the pair of lower ends 54 at the rear open end 44 of the desk. It is to be understood that the compatibly shaped circumferential grooves 62 and 64 may be inversely disposed relative to the front and rear end of the desk or can be laterally opposed. The purpose of the compatibly shaped inner and outer circumferential grooves 62 and 64 respectively will be explained in cooperative relation with a convenient stacking method of the book boxes 14, which will be described more below.

Figure 9:
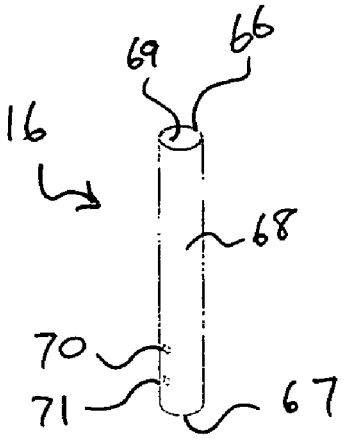
FIG. 9, in a perspective view, illustrates a sleeve insert part of the desk shown in FIGS. 1A to 2.

FIG. 9 shows a sleeve insert 16 that is represented by a substantially tubular hollow member that is preferably made of a suitably rigid material such as, for example, metal, a suitably rigid plastic, or the like. Sleeve insert 16 is generally defined as having an insert upper end 66, an insert lower end 67, an outer cylindrical surface 68 and an inner cylindrical surface 69. Sleeve insert 16 has a pair of longitudinally spaced apart, adjacent through holes 70 and 71, also referred to as sleeve insert apertures, that extend laterally through outer surface 68 that is relatively near the insert lower end 67 of the sleeve insert 16. Both through holes 70 and 71 typically have equivalent diameters.

Sleeve insert 16 has an overall length that is preferably slightly longer than the overall length of the sleeves 36 of the book box 14 described above, and a diametrical cross-section that is suitably sized such that it may be fully inserted, preferably in a snug-fit relation, through either the upper end 52, or lower end 54, of a sleeve 36, with its insert lower end 67 thereof oriented downwardly relative to the book box 14. Thus, once a sleeve insert 16 is inserted in a sleeve 36, as described above, with its insert upper end 66 that is substantially at level with the upper end 52 of sleeve 36, a relatively short lower portion of the sleeve insert 16 is protruding from the lower end 54 of the sleeve 36, as best illustrated in FIGS. 1A and 1B.

Once a sleeve insert 16 is thus inserted in a sleeve 36, as described above, through hole 70 is suitably disposed along the insert lower end 67 of sleeve insert 16 such that it may be centered relative to sleeve aperture 56 at the lower end 54 of sleeve 36. In turn, adjacent through hole 71 is thus longitudinally disposed along the portion of sleeve insert 16 that is protruding from the lower end 54 of sleeve 36.

IN some embodiments of the invention, sleeve apertures 56 near the lower open end 54 of sleeves 36, may have a slightly larger diameter than through holes 70 and 71 near the insert lower end 67 of sleeve insert 16.

Figure 10:
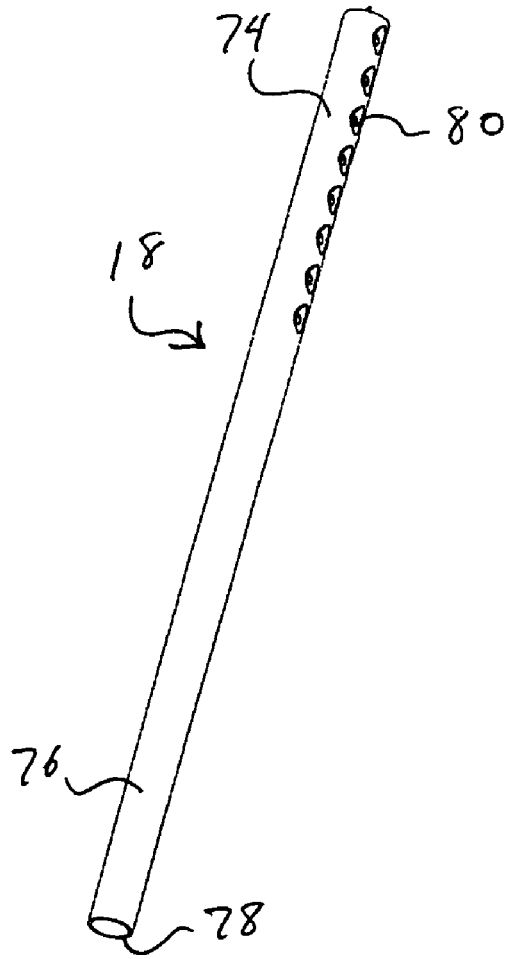
FIG. 10, in a perspective view, illustrates a leg member part of the desk shown in FIGS. 1A to 2.

FIG. 10 shows a leg member 18 that is represented by a substantially elongated and cylindrical hollow member having an upper end portion 74 and a lower end portion 76. The upper end portion 74 has a cross-sectional diameter that is suitably sized to be inserted telescopically, and preferably in a snug-fit relation, through sleeve insert 16, as seen in FIG. 1B for example.

The upper end portion 74 is provided with a plurality of lateral extending threaded leg apertures 80 that are equidistantly spaced apart and longitudinally aligned along the general axis of the leg member 18. The leg apertures 80 have a diameter that is relatively smaller than the diameter of the sleeve apertures 56 and through holes 70 and 71 of the sleeve 36 and sleeve insert 16 respectively. Furthermore, the distance between two adjacent holes 80 of the leg corresponds to the distance between the pair of through holes 70 and 71 of the sleeve insert 16 described above. Thus, when the upper end portion 74 of a leg member 18 is inserted through the insert lower end 67 of a sleeve insert 16, the pair of through holes 70 and 71 of the sleeve insert 16 can be simultaneously aligned with a pair of leg apertures 80 in the leg member 18.

The peripheral edge of the leg apertures 80 is preferably slightly recessed to ease the alignment of fastening elements, such as threaded screws 81, when fastening the leg members 18 to the desk 10, as it will be described more below. The plurality of leg apertures 80, in cooperative relation with a suitable threaded fastening element, such as a threaded screw 81 (as illustrated in FIG. 2), serve as a means to adjust the height of the desk 10, as it will be described in more details hereinbelow. Leg member 18 is typically made of a suitably rigid material such as, for example, metal, a suitably rigid plastic, a fiber reinforced plastic (FRP), or the like.

As mentioned above, the distal lower end 78 of the leg member 18 is preferably terminated with a conventional furniture leg glide or end cap 20 (as shown in FIGS. 1A, 1B and 2).

Leg member 18 is of a suitable length, and the number and disposition of its leg apertures 80 along upper end portion 74 are such that, when the height adjustable desk 10 is assembled, such as illustrated in FIGS. 1A and 1B, the height of the desk may be suitably adjusted to accommodate students of different heights. In other words, the height adjustable desk 10 of the present invention can be easily adjusted to accommodate students in primary school, high school and adult classes.

The leg member 18 and the sleeve insert 16 together form a leg 17 that is removably insertable into and securable to the sleeve 36. The through hole 70 is therefore a leg aperture positionable substantially in register with the sleeve aperture 56.

In a preferred method of pre-assembly and storage configuration of the height adjustable desk 10 for efficient space saving storage or shipping purposes, at least two book boxes 14 are each pre-assembled with their corresponding writing board 12 using any suitable fastening means such as screws 41.

Figure 11:
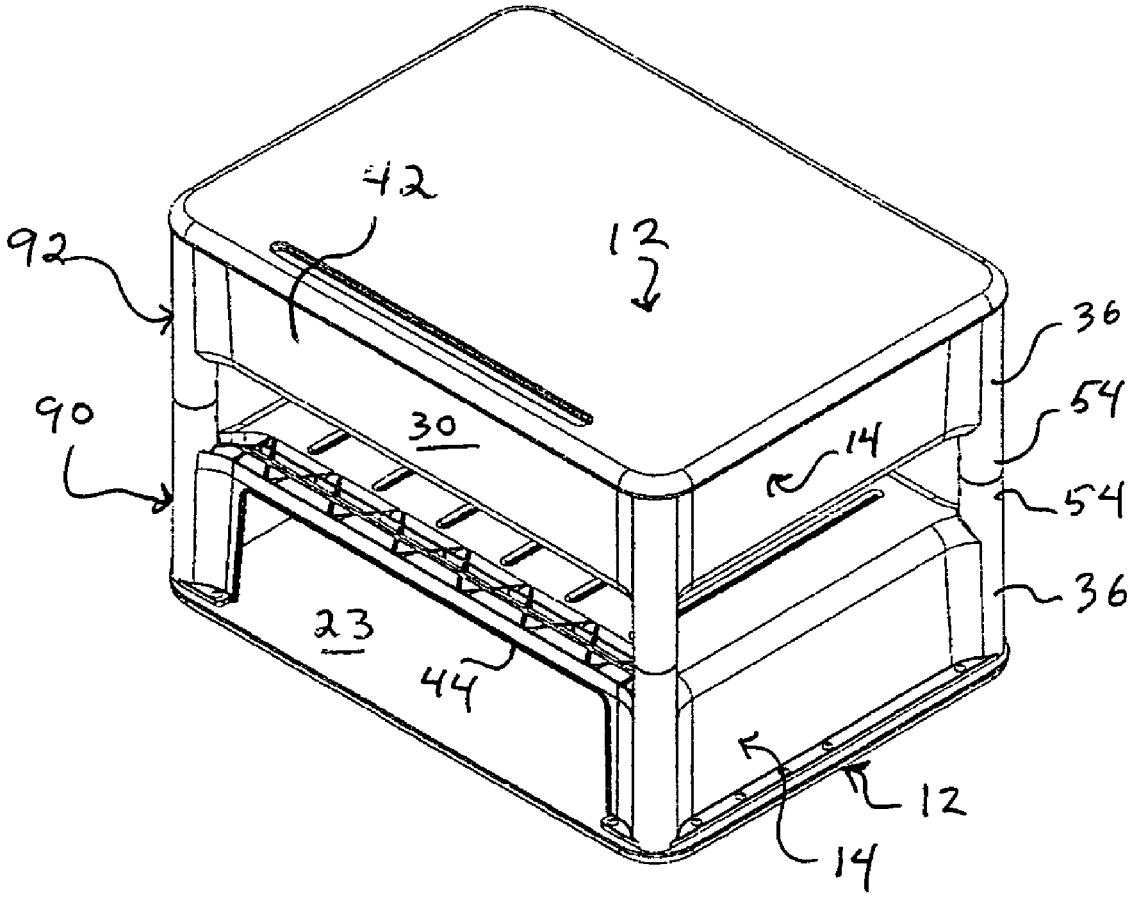
FIG. 11, in a perspective view, illustrates two book boxes such as the book boxes shown in FIGS. 3 and 5, the book boxes being shown in an oppositely disposed, storage configuration, where both book boxes are engaged through the lower ends of their sleeves.

Hence, as illustrated in FIG. 11, a pair thus pre-assembled book boxes 14 and writing boards 12, denoted by reference numerals 90 and 92, may be efficiently and stably stacked one on top of the other in an oppositely deposed configuration as described hereinafter. The first pre-assembled book box 90 is turned upside down on a stable surface, with the lower ends 54 of its sleeves 36 pointing upwardly. Next, the second pre-assembled book box 92 is stacked upright on top of the first book box, with its front end wall 30 facing in an opposite direction relative to the front wall 30 of the first book box, and the lower ends 54 of its four sleeves 36 oppositely corresponding with the four lower ends 54 of the first book box 14.

Thus, the pair of lower ends 54 of the sleeves 36 on each sides of the front end wall 30 of the first pre-assembled book box 90 stably engage with the compatibly shaped lower ends 54 of the sleeves 36 on each sides of the rear open end 44 of the second pre-assembled book box 92. Inversely, the pair of lower ends 54 of the sleeves 36 on each sides of the front end wall 30 of the second pre-assembled book box 92 stably engage with the compatibly shaped lower ends 54 of the sleeves 36 on each sides of the rear open end 44 of the first pre-assembled book box 90. In other words, the pre-assembled book boxes 90 and 92 are stackable on top of each other by inserting the ridges 63 of the book box 90 into the inner circumferential grooves 64 of the book box 92.

A plurality of pairs of pre-assembled book boxes 90, 92 thus stacked as described above may, in turn, be stably stacked one on top of the other for efficient mass storage and shipping purposes.

To complete the assembly of a desk 10, a set of four leg members 18 have their upper end portion 74 inserted in the insert lower end 67 of a corresponding number of sleeve inserts 16 until the through hole 71 of the sleeve insert 16 is aligned with a suitable leg aperture 80 of the leg member 18 such that the total length of the thus assembled sleeve insert 16 and leg member 18 roughly corresponds to the desired height of the desk 10. The leg 17 thus assembled is therefore telescopic. A suitable fastening element, such as a threaded screw 81, is then fastened through the corresponding through hole 71 and leg aperture 80 of the thus assembled sleeve inserts 16 and leg members 18 respectively.

Next, the insert upper end 66 of a sleeve inserts 16 thus fastened to its respective leg member 18, is inserted in the lower open end 54 of each of the four sleeves 36 of a pre-assembled book box 14 and writing board 12, as described above, such that the through hole 71 of the sleeve insert 16 is aligned with the sleeve aperture 56 of the sleeve 36. A threaded fastening element, such as a threaded screw 81, having a head 83 defining a head diameter slightly smaller than the diameter of sleeve aperture 56 but greater than through hole 70, may then be fastened through the thus corresponding sleeve apertures 56, through hole 70 and leg aperture 80 of the sleeve 36, the sleeve insert 16 and leg member 18 respectively. The threaded screw 81 may be fastened until the head 83 of the latter abuts against the surrounding surface of the relatively smaller through hole 70 of the sleeve insert 16 in order to firmly secure the leg member 18 to the desk 10. Thus, the head 83 of the threaded screw 81 serves as a locking means within sleeve aperture 56, in order to retain the sleeve insert 16 and leg member 18 assembly within sleeve 36.

Furthermore, the head 83 of the threaded screw 81 used to fasten the leg member 18 to the desk 10 is received and substantially concealed within the depth of the relatively larger sleeve aperture 56 provided through the sleeve 36 for preventing hand or finger injuries of, for example, students who may manipulate the desk 10.

In an alternate embodiment, lateral through hole 71 is not present through the lower portion of sleeve insert 16 such that only through hole 70 is used to adjust the height as well as fasten the leg member 18 to the book box 14, in cooperative relation with a sleeve insert 16 and a threaded screw 81. In the present embodiment, the method of assembly slightly differs compared to the first embodiment described above in that a sleeve insert 16 is first inserted, insert upper end 66 first, through the lower end 54 of each sleeve 36 of a pre-assembled book box 14 and writing board 12, with through hole 70 of the sleeve insert 16 carefully aligned with the corresponding sleeve aperture 56 of the sleeve 36. A leg member 18 is then inserted, upper end portion 74 first, through each insert lower end 67 of the sleeve inserts 16 thus positioned within the sleeves 36 of the desk, until a suitable leg aperture 80 of the leg member 18 is in turn aligned with the already corresponding sleeve aperture 56, through hole 70 and leg aperture 80. Finally, a threaded screw 81 is fastened through sleeve apertures 56, through hole 70 and leg aperture 80.

Although the above description contains many specificities, these should not be construed as limitations on the scope of the invention but is merely representative of the presently preferred embodiments of this invention. For example, the desk 10 may have any other suitable configuration than the conventional square or rectangular desk configuration. For examples, the desk 10 may have an oval, an hexagonal, an L-shaped configuration, or the like, and provided with a suitable number of legs 17 to offer a stable desk. Furthermore, the correspondingly shaped cross-sections of the cylindrical sleeves 36, sleeve inserts 16 and leg members 18 may as well have any other compatibly-shaped cross-section configuration such as, for examples, square, rectangular, hexagonal, oval or the like.

Also, while a specific configuration of the ridge 63 and recess formed by the inner circumferential groove 64 has been described hereinabove, some objects of the present invention can be achieved by having a free end of a first sleeve 36 that is shaped substantially complementarily to a free end of a second sleeve 36 such that when two pre-assembled book boxes 90 and 92 are stacked on top of each other with the free end of the first sleeve 36 engaging the free end of the second sleeve 36, movements of the two desks relatively to each other in a direction substantially parallel to their writing board 12 is substantially prevented.

Although the present invention has been described hereinabove by way of preferred embodiments thereof, it can be modified, without departing from the spirit and nature of the subject invention as defined in the appended claims.

What is claimed is:

1. A desk, said desk comprising:

a writing board, said writing board defining a top surface and a substantially opposed bottom surface;

at least three sleeves, each of said at least three sleeves extending substantially away from said bottom surface, each of said at least three sleeves defining a respective free end substantially opposed to said bottom surface, each of said at least three sleeves defining a sleeve aperture leading substantially laterally thereinto substantially adjacent said free end;

at least three legs, each of said at least three legs being removably insertable into and securable to a respective one of said at least three sleeves, each of said at least three legs defining a leg aperture positionable substantially in register with a respective one of said sleeve apertures when said at least three legs are each inserted in a respective one of said at least three sleeves; and at least three fasteners, each of said at least three fasteners being insertable into a respective one of said sleeve apertures and a respective one of said legs apertures;

at least one of said at least three legs including a leg member and a substantially tubular sleeve insert, said sleeve insert being insertable in one of said at least three sleeves, said leg member being insertable in said sleeve insert, said leg member being provided with at least two substantially longitudinally spaced apart leg apertures extending substantially laterally thereinto, said sleeve insert being provided with a sleeve insert aperture extending substantially laterally thereinto; wherein, when said leg is attached to said sleeve, one of said leg apertures, said sleeve insert aperture and said sleeve aperture are substantially in register with each other and one of said at least three fasteners is inserted through said one of said leg apertures, said sleeve insert aperture and said sleeve aperture;

a first one of said at least three sleeves defining a ridge extending substantially longitudinally therefrom at said free end of said first one of said at least three sleeves and a second one of said at least three sleeves defining a recess extending substantially longitudinally thereinto at said free end of said second one of said at least three sleeves, said recess being configured and sized for substantially snugly receiving said ridge;

whereby two of said desks are stackable on top of each other with legs detached therefrom by inserting said ridge of a first one of said two desks into said recess of a second one of said two desks and inserting said ridge of said second one of said two desks into said recess of said first one of said two desks and whereby selection of different ones of said leg apertures to attach said leg to said sleeve vary a length of said leg.

2. A desk as defined in claim 1, wherein said recess and said ridge are both substantially annular.

3. A desk as defined in claim 1, wherein said at least three sleeves are substantially perpendicular to said writing board.

4. A desk as defined in claim 1, wherein said at least three sleeves include four sleeves, each of said four sleeves extending substantially away from said bottom surface, each of said four sleeves defining a respective free end substantially opposed to said bottom surface; and said at least three legs include four legs, each of said four legs being removably insertable into and securable to a respective one of said four sleeves.

5. A desk as defined in claim 4, wherein said four sleeves are disposed in a substantially rectangular configuration.

6. A desk as defined in claim 4, wherein a first one and a second one of said four sleeves each define a respective ridge extending substantially longitudinally therefrom at said free end of said first and second ones of said four sleeves; and a third one and a fourth one of said four sleeves each define a respective recess extending substantially longitudinally thereinto at said free end of said third and fourth ones of said four sleeves, said recesses being configured and sized for substantially snugly receiving said ridges.

7. A desk as defined in claim 1, further comprising a book box extending from said bottom surface of said writing board.

8. A desk as defined in claim 7, wherein said at least three sleeves extend integrally from said book box at the periphery thereof.

9. A desk as defined in claim 7, further comprising a lip extending substantially away from said bottom surface in a substantially parallel and spaced apart relationship relative to said book box.

10. A desk as defined in claim 9, wherein said lip defines a flange projecting from said lip substantially toward said book box.

11. A desk as defined in claim 1, wherein said sleeve apertures are diametrically larger than said leg apertures, said at least three fasteners each defining a respective fastener head, said fastener heads being configured and sized so as to be substantially entirely receivable into said sleeve apertures.

12. A desk as defined in claim 1, wherein said at least three legs are telescopic.

13. A desk as defined in claim 1, further comprising a clip element extending substantially away from said bottom surface.

14. A desk as defined in claim 1, wherein said recess includes an inner substantially circumferential groove extending substantially longitudinally into said leg at said free end of said second one of said at least three sleeves and said ridge is defined by an outer substantially circumferential groove extending substantially longitudinally into said leg at said free end of said first one of said at least three sleeves.

* * * * *